United States Patent [19]

Benjamin et al.

[11] 4,110,498

[45] Aug. 29, 1978

[54] FABRIC TREATMENT COMPOSITIONS

[75] Inventors: Lawrence Benjamin, Springfield Township, Hamilton County; Michael Andrew Walsh, Fairfield, both of Ohio

[73] Assignee: The Procter & Gamble Company, Cincinnati, Ohio

[21] Appl. No.: 664,837

[22] Filed: Mar. 8, 1976

[51] Int. Cl.[2] ..... D06M 13/00

[52] U.S. Cl. ..... 428/35; 252/8.6; 252/8.8; 428/260; 428/272; 428/274; 428/289; 428/290; 428/304; 428/411; 428/530; 428/537; 428/540; 427/242

[58] Field of Search ..... 427/242; 252/8.6, 8.8; 428/35, 260, 272, 274, 289, 290, 304, 411, 530, 537, 540

[56] References Cited

U.S. PATENT DOCUMENTS

| | | | |
|---|---|---|---|
| 2,402,551 | 6/1946 | Holt | 106/14 |
| 2,417,028 | 3/1947 | Wells | 427/242 X |
| 2,460,259 | 1/1949 | Kahler | 427/242 X |
| 2,564,423 | 8/1951 | Barnum | 106/14 |
| 2,735,790 | 2/1956 | Waitkus | 427/242 X |
| 3,442,692 | 5/1969 | Gaiser | 427/242 X |
| 3,501,335 | 3/1970 | Cahn et al. | 427/242 X |
| 3,676,199 | 7/1972 | Hewitt et al. | 427/242 X |
| 3,686,025 | 8/1972 | Morton | 427/242 X |
| 3,796,599 | 2/1974 | McLaughlin | 427/242 |
| 3,870,145 | 3/1975 | Mizuno | 427/242 X |
| 4,000,340 | 12/1976 | Murphy et al. | 252/8.6 X |
| 4,022,938 | 5/1977 | Zaki et al. | 427/242 |

FOREIGN PATENT DOCUMENTS

| | | | |
|---|---|---|---|
| 805,887 | 2/1974 | Belgium | 427/242 |
| 1,383,748 | 2/1975 | United Kingdom | 427/242 |

*Primary Examiner*—Michael R. Lusignan
*Attorney, Agent, or Firm*—Ronald L. Hemingway; Richard C. Witte

[57] ABSTRACT

Anti-static fabric softening articles and methods which utilize a composition comprising a cationic fabric softener in combination with lanolin alcohols (or certain derivatives thereof) as a second fabric softener and release aid. The composition is releasably affixed or incorporated into a dispensing means and applied to fabrics in an automatic laundry dryer.

18 Claims, No Drawings

FABRIC TREATMENT COMPOSITIONS

BACKGROUND OF THE INVENTION

The present invention relates to articles and methods for imparting softening and anti-static benefits to fabrics in an automatic laundry dryer. More specifically, damp fabrics are commingled with a softening composition containing cationic fabric softener and a "lanolin alcohol" component in an automatic clothes dryer to provide a soft, anti-static finish concurrently with the drying operation. The softening compositions herein are employed in combination with a dispensing means adapted for use in an automatic dryer. The lanolin alcohol component not only provides fabric softening, but also serves to improve release of the softening composition from certain types of dryer dispensing means. Furthermore, the lanolin alcohol component, when used in combination with the cationic fabric softening agents herein reduce the tendency which said cationic materials have to stain fabrics and to cause metal corrosion and/or paint softening in laundry dryers.

Fabric "softness" is an expression well defined in the art and is usually understood to be that quality of the treated fabric whereby its handle or texture is smooth, pliable and fluffy to the touch. Various chemical compounds have long been known to possess the ability to soften fabrics when applied to them during a laundering operation.

Fabric softness also connotes the absence of static "cling" in the fabrics, and the commonly used cationic fabric softeners desirably provide both softening and anti-static benefits when applied to fabrics. Indeed, with fabrics such as nylon and polyester, the user is more able to perceive and appreciate an anti-static benefit than a true softening benefit.

Fatty alkyl cationic anti-static softening compounds and compositions designed for application to fabrics in an automatic dryer have been the subject of recent innovations. (See, for example, Furgal, U.S. Pat. No. 3,634,947, issued Jan. 18, 1972; Morton, U.S. Pat. No. 3,686,025, issued Aug. 22, 1972 and Gaiser, U.S. Pat. No. 3,442,692, issued May 6, 1969.) Other fatty materials have been suggested for use as dryer-added fabric softeners (See, for example, Hewitt et al, U.S. Pat. No. 3,676,199, issued July 11, 1972 and the co-pending application of Murphy and Habermehl, Ser. No. 417,329, filed Nov. 19, 1973, now U.S. Pat. No. 4,000,340, issued Dec. 28, 1976). Included among these prior softening compositions are various glycerides in combination with oil-soluble, lower-ethoxylated surfactants. Glyceride fabric treating agents are disclosed in Bernholz et al, U.S. Pat. No. 3,785,973, issued Jan. 15, 1974; Grimm U.S. Pat. No. 3,896,033, issued July 22, 1975; copending application Ser. No. 440,931, Murphy et al., filed Feb. 8, 1974; and U.S. Pat. No. 4,000,340, Murphy et al., issued Dec. 28, 1976.

As pointed out in Hewitt et al, U.S. Pat. No. 3,676,199, issued July 11, 1972 and Wixon, U.S. Pat. No. 3,766,062, issued Oct. 16, 1973, many of the prior art softening agents stain or discolor the conditioned fabrics when used in an automatic dryer. The unfortunate tendency of such materials to stain fabrics is apparently caused by the presence of the fatty alkyl groups in the active softening compounds which causes them to be somewhat "greasy". Unevenly distributed fatty softeners can appear as blotchy, oily stains on the treated fabrics. Thus, the chemical structure which gives rise to the soft, lubricious feel associated with the prior art softeners can cause them to be potential fabric stainers.

A variety of mechanical methods have been employed in an attempt to reduce the tendency of dryer-added softeners to stain fabrics. The prior art fabric softening agents, for example, have been sorbed onto flexible articles designed to provide controlled release at dryer operating temperatures. While such articles are quite attractive from the standpoint of ease of manufacture and economics, staining can still be a problem if an improperly formulated flexible article becomes entangled in clothing. Various rigid dispensers and appliances have been designed which assertedly avoid any exceptionally high, localized concentration of softening agent being undesirably deposited on the fabrics in the form of greasy stains (See Hoeflin, U.S. Pat. No. 3,633,538, issued Jan. 11, 1972 and Grand et al, U.S. Pat. No. 3,698,095, issued Oct. 17, 1972). However, such dispensers are costly and have not come into general use.

Certain surfactants have been suggested for obviating the tendency of the prior art softeners to stain fabrics (See the co-pending application of Murphy and Habermehl, Ser. No. 440,932, filed Feb. 8, 1974). This non-staining aspect is especially important when the common polyester fabrics, which are oleophilic and particularly susceptible to oily staining, are softened in an automatic dryer. However, such surfactants are mainly anionic in nature, and are not suitable for use with the common cationic softeners.

As noted above, many softening compounds have been adapted for use in automatic dryers by fashioning articles which contain a pre-measured amount of the softener. Preferred articles comprise a flexible sheet substrate coated and/or impregnated with an optimal, pre-measured amount of a fabric softener. These articles are simply added to a dryer together with the fabrics to be dried. The heat and tumbling action of the dryer helps dispense the softener onto the fabric surfaces (See for example, Perez-Zamora, U.S. Pat. No. 3,632,396, issued Jan. 4, 1972). However, once sorbed onto the sheet substrate, some softeners tend to remain affixed thereto, rather than being dispensed onto the fabrics. Thus, the user of such articles cannot be assured that the optimal amount of softener is, in fact, deposited on the fabrics. To obviate this problem, it has been suggested to layer the softener onto the sheet together with surfactant-type release agents which insure substantially complete transfer to the fabrics; (See Perez-Zamora, U.S. Pat. No. 3,632,396, issued Jan. 4, 1972). Glycerides are among the materials recognized by Perez-Zamora as being useful as release agents for various types of softeners.

Finally, some cationic materials recognized for use as fabric softeners and anti-static agents in dilute aqueous rinse baths are not particularly useful in certain automatic dryers in that they are reported to soften and loosen certain paints used to protect the dryer drum and to corrode exposed metal surfaces of some automatic dryer drums.

As can be seen from the foregoing, there is considerable interest in providing reduced staining fabric softeners which can be conveniently applied to fabrics in an automatic clothes dryer. Moreover, the difficulty in securing controlled softener release from dispensers is well-recognized by workers in this field. Finally, there is likewise considerable interest in eliminating or minimizing dryer paint softening and corrosion caused by some dryer-added fabric treating products.

By the present invention, lanolin alcohols, or certain esters and propylene oxide adducts thereof are added to cationic fabric softeners to provide particularly useful dryer-added softener compositions and articles. The lanolin alcohols (or specified derivatives thereof) provide auxiliary softening and anti-static treatment of fabrics along with that provided by the cationic softeners. Moreover, the lanolin alcohols and derivatives provide even release of softening compositions from carrier substrates when such substrates provide the means for dispensing the softening compositions herein into automatic dryers, thereby reducing staining problems. Finally, the lanolin alcohols and derivatives reduce the tendency of the cationic softener material to soften paint and corrode metal surfaces in automatic clothes dryers.

Various compounds containing hydroxyl groups are recognized as useful fabric treating agents in aqueous media, e.g., those listed in Speel et al, *Textile Chemicals and Auxiliaries,* 2nd Edition; Reinhold Publishing Corporation, 1957. Some ethoxylated alcohols are further known to be useful in textile lubricating compositions in combination with quaternary ammonium materials (See Cohen et al, U.S. Pat. No. 3,773,463, issued Nov. 20, 1973).

The use of various glycerides to lubricate and soften textiles is well known in the art. See for example U.S. Pat. No. 3,785,973. Likewise, their use for the treating of fabrics in a laundry with or without the presence of relatively low levels of quaternary ammonium softeners has been disclosed in application Ser. No. 440,931, filed Feb. 8, 1974, U.S. Pat. No. 4,000,340, cited supra. The use of various polyol esters to condition fabrics in a dryer is disclosed in British Pat. No. 1,383,748, published Feb. 12, 1975. The use of fatty sorbitan esters with high levels of quaternary ammonium softeners in dryer-added fabric treatment articles to improve softener release and reduce fabric staining and dryer damage has been disclosed in application Ser. No. 543,607, Zaki, filed Jan. 23, 1975, (now U.S. Pat. No. 4,022,938, issued May 10, 1977) which is a continuation-in-part of Ser. No. 461,312, filed Apr. 16, 1974, now abandoned. Fabric treating compositions comprising glycerides and cationic softeners are disclosed in U.S. Pat. No. 2,735,790, Waitkus, issued Feb. 21, 1956.

U.S. application Ser. No. 647,969, McCarty et al., filed Jan. 9, 1976, discloses the use of polyglycerol esters as fabric softening agents for use in treating fabrics in a dryer.

Belgian Pat. No. 805,887, Liebowitz et al., published Feb. 1, 1973, discloses the use of lanolin and hydrophilic derivatives thereof as fabric softening agents in aerosol compositions for use in the dryer.

U.S. application Ser. No. 647,970, Norris, filed Jan. 9, 1976, discloses the use of fatty acid esters of various polyols as fabric softening agents to be used in combination with quaternary ammonium softeners in softening fabrics in a dryer and thereby reducing the corrosive effect which quaternary softeners have on metal and painted surfaces in the dryer.

The above prior art references do not suggest the formulation of dryer-added fabric softening articles of the type disclosed herein comprising a dryer dispensing means, a cationic softener, and a lanolin fatty alcohol component of the type and in the amounts specified herein, nor do these references suggest the anti-corrosion, anti-paint softening benefits provided by the particular mixture of materials employed herein in automatic laundry dryers.

Accordingly, it is an object herein to provide superior methods and articles of manufacture adapted for imparting softness and anti-static benefits to fabrics in a clothes dryer.

It is another object herein to provide such fabric softening articles which are easily manufactured on a commercial scale.

It is another object herein to provide dryer fabric softening articles and methods which do not disadvantageously promote softening of dryer drum paint or corrosion of exposed metal dryer drum surfaces.

These and other objects are obtained herein as will be seen from the following disclosure.

SUMMARY OF THE INVENTION

The present invention encompasses an article of manufacture adapted for use in an automatic dryer comprising (a) a fabric softening amount of a fabric softening composition containing a cationic softener of the type disclosed hereinafter and a lanolin alcohol component, as defined hereinafter, and (b) a dryer dispensing means releasably containing an effective amount of said fabric softening composition. The dryer dispensing means provides for release of the fabric softening composition at automatic dryer operating temperatures, i.e., about 38°-100° C, and release is preferably facilitated by the tumbling action of the damp fabrics in the dryer.

The invention also encompasses a method for imparting a softening and anti-static effect to fabrics in an automatic dryer comprising commingling pieces of damp fabric by tumbling said fabrics under heat in a clothes dryer with an effective, i.e., softening, amount of a mixture comprising a cationic fabric softener component and a lanolin alcohol component, in the amounts and ratios as hereinafter specified.

DETAILED DESCRIPTION OF THE INVENTION

The articles herein are fashioned from certain cationic fabric softeners, lanolin alcohols or certain derivatives thereof, and a dryer dispensing means, all as more fully described hereinafter.

FABRIC SOFTENING COMPOSITIONS

The fabric softening compositions employed in the present invention comprise from about 40% to about 95% (by weight) of a conventional cationic fabric softening material and from about 5% up to 60% (by weight) of a lanolin alcohol (or derivative thereof) component as a fabric softening agent, release aid and anti-corrosion, anti-paint softening agent. All percentages herein are "by weight," unless specified otherwise. The weight ratio of cationic material to lanolin alcohol component is 0.67:1 or greater. The compositions have a melting point above about 38° C and are flowable at fabric dryer operating temperatures. Generally, the melting point is between about 38° C and 100° C. In addition to performing a fabric softening function, such compositions provide an anti-static effect when employed in the dryer and further are surprisingly compatible with dryer drum metal and paint.

CATIONIC SOFTENER COMPONENT

The cationic component of the fabric softening compositions herein can comprise any of the cationic (including imidazolinium) compounds listed in Morton, U.S. Pat. No. 3,686,025, issued Aug. 22, 1972, and Diery et al, U.S. Pat. No. 3,849,435, issued Nov. 19, 1974; both patents incorporated herein by reference. Such materials are well known in the art and include, for example, the quaternary ammonium salts having at least one, preferably two, $C_{10}$–$C_{22}$ fatty alkyl substituent groups; alkyl imidazolinium salts wherein at least one alkyl group contains a $C_8$–$C_{25}$ carbon "chain"; the $C_{12}$–$C_{20}$ alkyl pyridinium salts, and the quaternary materials derived from fatty amidoamines.

Preferred softeners herein include the cationic quaternary ammonium salts of the general formula $R^1R^2R^3R^4N^+X^-$, wherein groups $R^1$, $R^2$, $R^3$ and $R^4$ are, for example, alkyl and $X^-$ is an anion, e.g., halide, methylsulfate, ethylsulfate and the like. Especially preferred softeners herein are those wherein $R^1$ and $R^2$ are each $C_{12}$–$C_{22}$ fatty aliphatic acyclic groups, $R^3$ and $R^4$ are each $C_1$–$C_3$ alkyl and $X^-$ is methyl sulfate. The fatty alkyl groups can be mixed, i.e., the mixed $C_{14}$–$C_{18}$ coconut-alkyl and mixed $C_{16}$–$C_{18}$ tallowalkyl quaternary compounds. Alkyl groups $R^3$ and $R^4$ are preferably methyl. As noted, useful quaternary ammonium compounds herein are set forth in more detail in Morton, U.S. Pat. No. 3,686,025, issued Aug. 22, 1972.

Particularly useful quaternary ammonium softeners herein include ditallowalkyldimethylammonium methylsulfate, distearyldimethylammonium methylsulfate, dipalmityldimethylammonium methylsulfate and dibehenyldimethylammonium methylsulfate.

It is to be recognized that it is essential to the operation of the articles and methods herein that the softening composition substantially melt and flow at dryer operating temperatures (ca. 38°–100° C), thereby providing for transfer of the softening composition by contact with fabrics. While many cationic fabric softeners are solids which do not exhibit optimal flow properties at dryer operating temperatures, the lanolin alcohols, and derivatives thereof, used herein in admixture with these cationic compounds have now been found to lower the melting point range of these materials to well within the optimal dryer operating temperature range.

It should be further recognized that the cationic softeners useful herein can contain minor amounts of free (unquaternized) amines, lower chain length materials, and the like, which arise from processing. The presence or absence of such contaminants is of no consequence in the articles or methods herein. The compositions herein contain from about 40% to about 95% cationic fabric softener, preferably 50% to 85%, most preferably 50% to 70%.

THE LANOLIN ALCOHOL COMPONENT

The lanolin alcohol component of the fabric softening compositions herein comprises the alcohols which occur naturally in lanolin, the aliphatic carboxylic acid esters of said alcohols wherein the acid moieties contain from 2 to about 22 carbon atoms and the propylene oxide adducts of said alcohols wherein said adducts contain from about 1 to about 20 moles of propylene oxide per mole of lanolin alcohol.

Lanolin is wool fat which has been purified by various purification steps including washing, neutralization, filtration, bleaching and deodorization. Included within the lanolin is a complex mixture of sterols and terpene alcohols, and this mixture is referred to collectively as lanolin alcohols. Specific alcohols included within the mixture are cholesterol, 7-dehydrocholesterol, dihydrocholesterol, cerebosterol, agnosterol, lanosterol, dihydrolanosterol and dihydroagnosterol. The lanolin alcohols can be used individually as the lanolin alcohol component of the present invention, however, it is generally preferred for cost reasons to use the naturally occurring mixtures.

The lanolin alcohol derivatives which can be used as the lanolin alcohol component of the compositions of the present invention comprise the $C_1$ to $C_{22}$ aliphatic carboxylic esters of lanolin alcohols and the propylene oxide adducts of said alcohols wherein said adduct contains from about 1 to about 20 (preferably from about 1 to 8), moles of propylene oxide per mole of alcohol. Examples of esters of lanolin alcohols are the acetates (e.g., acetylated lanolin alcohols), 2-propenoates, butyrates, hexanoates, laurates, palmitates, oleates, linoleates, stearates and behenates.

Lanolin alcohols, as well as esters and propoxylates thereof are available commercially from Amerchol, a unit of CPC International, Inc.

Preferred materials for the lanolin component herein are lanolin alcohols (e.g., Amerchol CAB®) and the polypropylene oxide (2) adduct of lanolin alcohol (e.g., Solulan PB-2® from Amerchol) and acetylated lanolin (e.g., Acetulan® from Amerchol).

The amount of lanolin alcohols, or derivatives thereof, used in the composition of the present invention can vary from about 5% to about 60% of the composition and is preferably from about 15% to about 50% and most preferably from about 30% to about 50%. The lanolin alcohols or derivatives can be used singly or in combination.

Lanolin and its derivatives are known to have beneficial conditioning effects on the skin. Therefore, an added benefit achieved by the present invention is that fabrics treated in accordance with the invention, and used in a manner so as to come into contact with the skin, provide a means of exposing the skin to the beneficial effects associated with lanolin.

OPTIONAL SOFTENER COMPOSITION COMPONENTS

Various additives can also be used in combination with cationic/lanolin alcohol component softening compositions herein. Although not essential to the invention herein, certain fabric treating additives are particularly desirable and useful, e.g., perfumes, brightening agents, shrinkage controllers, spotting agents, and the like.

While not essential, liquids which serve as a carrier for the softening agents can also be employed as part of the softening compositions herein. Such liquids can be used, for example, to impregnate an absorbent substrate more evenly with the composition when such an absorbent substrate is employed (as discussed hereinafter) as the dryer dispensing agent for the softener compositions herein. When a liquid carrier is so used, it should be inert or stable with both components of the softening composition. Moreover, the liquid carrier used in substrate impregnation should be substantially evaporated at room temperature, and the residue (i.e., the softening composition and other optional materials) should then be sufficiently hardened so as not to run or drip off the substrate, or cause the substrate to stick together when folded. Isopropyl alcohol is the preferred liquid carrier for substrate impregnation purposes. Methanol, ethanol, acetone, ethylene glycol, propylene glycol, fatty alcohol ethoxylate nonionic surfactants and/or liquefied fluorocarbons such as dichlorodifluoroethane and dichlorodifluoromethane can also be used as carriers either for dispensing the softening composition in the dryer, for introducing the softening compositions into the dryer dispensing means or for facilitating release of the softening compositions from the dryer dispensing means.

Other additives can include anti-creasing agents, finishing agents, fumigants, lubricants, fungicides, and sizing agents. Specific examples of useful additives disclosed herein can be found in any current Year Book of the American Association of Textile Chemists and Colorists. Any additive used should be compatible with the softening agent.

The amounts of fabric treating additives (e.g., perfume and brighteners, etc.) that are generally used in combination with the softening agents are generally small, being in the range of from 0.01% to 10% by weight of the total mixed cationic/lanolin alcohol component softening composition. When the compositions of the invention are dispensed from a spray device (e.g., aerosol can, mechanical pump spray, etc.) the composition will generally be present with a relatively high level of a carrier in said devices, the carriers being such materials as solvents and/or propellants. In such devices, the compositions of the present invention are used at levels of about 5% to 30% composition and 95% to 70% carrier. Examples of solvent carriers are ethanol and isopropanol. Examples of propellants are the Freons (e.g., Freon 12 and Freon 114). For purposes of describing the invention herein, the carrier materials will be considered part of the dispensing device.

Although the compositions described herein are designed to be especially useful in conditioning fabrics when dispensed into the dryer, they also provide significant fabric conditioning effects when dispensed into the rinse cycle of the washing process.

DISPENSING MEANS

The mixed cationic softener/lanolin alcohol component softening compositions, herein can be employed by simply adding a measured amount of said composition into the dryer. However, in a preferred embodiment, the mixed softening compositions are provided as an article of manufacture in combination with a dispensing means which effectively releases the softening compositions in an automatic clothes dryer. Such dispensing means can be designed for single usage or for multiple uses.

One such article comprises a sponge material releasably enclosing enough mixed softening composition to effectively impart fabric softness during several cycles of clothes drying. This multi-use article can be made by filling a hollow sponge with about 20 grams of the mixture of the mixed softener composition. In use, the mixture melts and leaches out through the pores of the sponge to soften fabrics. Such a filled sponge can be used to treat several loads of fabrics in conventional dryers, and has the advantage that it can remain in the dryer after use and is not likely to be misplaced or lost.

Another article comprises a cloth or paper bag releaseably enclosing the mixed softening composition and sealed with a hardened plug of the mixture. The action and heat of the dryer opens the bag and releases the mixture to perform its softening function.

Still another article comprises an aerosol cannister containing the above-described softening compositions under pressure. The composition can be dispensed from this aerosol article onto the dryer drum in the manner more fully described in Rudy et al, U.S. Patent 3,650,816, issued March 21, 1972, incorporated herein by reference.

Other devices and articles suitable for dispensing dispensing fabric softening compositions herein in automatic dryers include those described in Dillarstone, U.S. Pat. No. 3,736,668, issued June 5, 1973; Compa et al, U.S. Pat. No. 3,701,202, issued Oct. 31, 1972; Furgal, U.S. Pat. No. 3,634,947, issued Jan. 18, 1972; Hoeflin, U.S. Pat. No. 3,633,538, issued Jan. 11, 1972 and Rumsey, U.S. Pat. No. 3,435,537, issued Apr. 1, 1969. All of these patents are incorporated herein by reference.

A highly preferred single-use article herein comprises the softening compositions containing the mixture of cationic softener and lanolin alcohol (or derivative thereof) releasably affixed to a flexible sheet substrate such as, for example, a sheet of paper, a sheet of woven or non-woven cloth substrate or a sheet of foamed plastic such as polyurethane. When such an article is placed in an automatic laundry dryer, the heat and tumbling action of the dryer removes the softening mixture from the substrate and deposits it on the fabrics.

The sheet conformation has several advantages. For example, effective amounts of the mixed softening compositions for use in conventional dryers can be easily sorbed onto and into the sheet substrate by a simple dipping or padding process. Thus, the user need not measure the amount of softening mixture necessary to obtain fabric softness. Additionally, the flat configuration of the sheet provides a large surface area which results in efficient release of the softener materials onto fabrics by the tumbling action of the dryer.

The water-insoluble paper, or woven or non-woven substrates used in the articles herein can have a dense, or more preferably, open or porous structure. Examples of suitable materials which can be used as substrates herein include paper, woven cloth, and non-woven cloth. The term "cloth" herein means a woven or non-woven substrate for the articles of manufacture, as distinguished from the term "fabric" which encompasses the clothing fabrics being dried in an automatic dryer.

Highly preferred paper, woven or non-woven "absorbent" substrates useful herein are fully disclosed in Morton, U.S. Pat. No. 3,686,024, issued Aug. 22, 1972, cited above. It is known that most substances are able to absorb a liquid substance to some degree; however, the term "absorbent", as used herein, is intended to mean a substrate with an absorbent capacity (i.e., a parameter representing a substrate's ability to take up and retain a liquid) from 2 to 25.

Determination of absorbent capacity values is made by using the capacity testing procedures described in U.S. Federal Specifications UU-T-595b, modified as follows:

(1) tap water is used instead of distilled water;
(2) the specimen is immersed for 30 seconds instead of 3 minutes;
(3) draining time is 15 seconds instead of 1 minute; and
(4) the specimen is immediately weighed on a torsion balance having a pan with turned-up edges.

Absorbent capacity values are then calculated in accordance with the formula given in said Specification. Based on this test, one-ply, dense bleached paper (e.g., kraft or bond having a basis weight of about 32 pounds per 3,000 square feet) has an absorbent capacity of 3.5 to 4; commercially available household one-ply toweling paper has a value of 5 to 6; and commercially available two-ply household toweling paper has a value of 7 to about 9.5.

Using a substrate with an absorbent capacity of less than 2 tends to cause too rapid release of the softening agents from the substrate resulting in several disadvantages, one of which is uneven softening of the fabrics. Using a substrate with an absorbent capacity over about 25 is undesirable, inasmuch as too little of the softening agent mixture is released to soften the fabrics in optimal fashion during a normal drying cycle. If the substrate is a woven or non-woven cellulosic cloth or paper, rather than a foamed plastic material, the absorbency should preferably be in the range of 4 to 12, most preferably between about 5 and 7. For foamed plastic materials, the preferable absorbency is preferably in the range of from about 15 to 22.

The use of dense, one-ply or ordinary kraft or bond paper for the softening article substrate can result in increased staining of certain types of treated fabrics. This staining is caused by the low absorbent capacity of the paper substrate.

As noted above, suitable materials which can be used as a substrate in the invention herein include, among others, sponges (e.g., foamed plastics), paper, and woven and non-woven cloth all having the necessary absorbency requirements defined above. The preferred substrates of the softening compositions herein are cellulosic, particularly multi-ply paper and non-woven cloth.

More specifically, a preferred paper substrate comprises a compressible, laminated, calendered, multi-ply, absorbent paper structure. Preferably, the paper structure has 2 or 3 plies and a total basis weight of from 14 to 90 pounds per 3,000 square feet and absorbent capacity values within the range of 7 to 10. Each ply of the preferred paper structure has a basis weight of about 7 to 30 pounds per 3,000 square feet, and the paper structure cans consist of plies having the same or different basis weights. Each ply is preferably made from a creped, or otherwise extensible, paper with a creped percentage of about 15% to 40% and a machine direction (MD) tensile and cross-machine (CD) tensile of from about 100 to 1,500 grams per square inch of paper width. The two outer plies of a 3-ply paper structure or each ply of a 2-ply paper structure are embossed with identical repeating patterns consisting of about 16 to 200 discrete protuberances per square inch, raised to a height of from about 0.010 inch to 0.40 inch above the surface of the unembossed paper sheet. From about 10% to 60% of the paper sheet surface is raised. The distal ends (i.e., the ends away from the unembossed paper sheet surface) of the protuberances on each ply are mated and adhesively joined together, thereby providing a preferred paper structure exhibiting a compressive modulus of from about 200 to 800 inch-grams per cubic inch and Handle-O-Meter (HOM) MD and CD values of from about 10 to 130.

Suitable adhesives for multi-ply paper are known in the art and include water, starches, wet-strength resins, and polyvinyl acetates. A particularly suitable adhesive is prepared by heating from about 2 to about 4 parts by weight of substantially completely hydrolyzed polyvinyl alcohol resin in from about 96 to about 98 parts by weight of water. Preferably, about 0.03 pound of adhesive solids are used to join 3,000 square feet of the embossed plies, with the adhesive being applied to the distal surfaces of the protuberances of one or all plies.

The compressive modulus values which define the compressive deformation characteristics of a paper structure compressively loaded on its opposing surfaces, the HOM values which refer to the stiffness of handle of a paper structure, the MD and CD HOM values which refer to HOM values obtained from paper structure samples tested in a machine and cross-machine direction, the methods of determining these values, the equipment used, and a more detailed disclosure of the paper structure preferred herein, as well as methods of its preparation, can be found in Wells; U.S. Pat. No. 3,414,459, issued Dec. 3, 1968, the disclosures of which are incorporated herein by reference.

The preferred non-woven cloth substrates used in the invention herein can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e., an array of fibers in a carded web wherein partial orientation of the fibers is frequently present, as well as a completely haphazard distributional orientation), or substantially aligned. The fibers or filaments can be natural (e.g., wool, silk, jute, hemp, cotton, linen, sisal, or ramie) or synthetic (e.g., rayon, cellulose ester, polyvinyl derivatives, poly-olefins, polyamides, or polyesters).

Methods of making non-woven cloths are not a part of this invention and, being well known in the art, are not described in detail herein. Generally, however, such cloths are made by air- or water-laying processes in which the fibers or filaments are first cut to desired lengths from long strands, passed into a water or air stream, and then deposited onto a screen through which the fiber-laden air or water is passed. The deposited fibers or filaments are then adhesively bonded together, dried, cured, and otherwise treated as desired to form the non-woven cloth. Non-woven cloths made of polyesters, polyamides, vinyl resins, and other thermoplastic fibers can be spun-bonded, i.e., the fibers are spun out onto a flat surface and bonded (melted) together by heat or by chemical reactions.

The absorbent properties preferred herein are particularly easy to obtain with non-woven cloths and are provided merely by building up the thickness of the cloth, i.e., by superimposing a plurality of carded webs or mats to a thickness adequate to obtain the necessary absorbent properties, or by allowing a sufficient thickness of the fibers to deposit on the screen. Any diameter or denier of the fiber (generally up to about 10 denier) can be used, inasmuch as it is the free space between each fiber that makes the thickness of the cloth directly related to the absorbent capacity of the cloth, and which, further, makes the non-woven cloth especially suitable for impregnation with a softening composition by means of intersectional or capillary action. Thus, any thickness necessary to obtain the required absorbent capacity can be used.

The choice of binder-resins used in the manufacture of non-woven cloths can provide substrates possessing a variety of desirable traits. For example, the absorbent capacity of the cloth can be increased, decreased, or regulated by respectively using a hydrophilic binder-resin, a hydrophobic binder-resin, or a mixture thereof, in the fiber bonding step. Moreover, the hydrophobic binder-resin, when used singly or as the predominant compound of a hydrophobic-hydrophilic mixture, provides non-woven cloths which are especially useful as substrates when the softening articles herein are used with damp fabrics in an automatic dryer.

The preferred fabric softening articles of the present invention are structured to be compatible with conventional laundry dryer designs. While it is preferred to employ the articles of the present invention in an automatic laundry dryer, other equivalent machines can be employed, and in some instances, heat and drying air may be omitted for part or all of the cycle. Generally, however, heated air will be employed and such air will be circulated frequently in the dryer. Normally, there are from about 5 to 50 volume changes of drying air in the dryer drum per minute and the air moves at about 125 to 175 cubic feet per minute. These changing volumes of air create a drawing or suction effect which can, especially with small fabric loads, cause an item such as a sock, handkerchief or the like, or a fabric conditioning article, to be disposed on the surface of the air outlet of the dryer. A usual load of fabrics of from about 4 to 12 pounds dry weight will fill from about 10% to 70% of the volume of most dryers and will normally pose little difficulty. A sufficient number of tumbling items will normally be present to prevent any item from being drawn to the exhaust outlet or to cause it to be removed from the outlet. In the event, however, a fabric softening article is caused to be disposed in relation to the air exhaust outlet in such a manner as to cause blockage of passing air, undesirable temperature increases can result. In the case of fabric softening articles, the softening compositions substantially melt under conditions of heat, and the article may tend to adhere to an exhaust outlet.

The problem of blockage can be solved by providing openings in the article in the manner described in two U.S. patent applications of A. R. McQueary, one having Ser. No. 347,605, filed Apr. 3, 1973, now U.S. Pat. No. 3,944,694, issued Mar. 16, 1976, and the other having Ser. No. 347,606, filed Apr. 3, 1973 now U.S. Pat. No. 3,956,556, issued May 11, 1976, both incorporated herein by reference. More specifically, slits or holes are cut through the substrate or formed in situ in the substrate to allow free passage of air.

The slit or hole openings are provided in the preferred fabric softening articles of the invention for two principal purposes. Importantly, the openings permit passage of air in the event the article is placed in a blocking relationship to the air exhaust outlet. Moreover, the openings provide a degree of flexibility or resiliency which causes the article to crumple or pucker. The effect of such crumpling is that only a portion of the air exhaust outlet will be covered by the softening article in the event it is carried by the moving air stream to the exhaust outlet. Moreover, the crumpled article is more readily removed by tumbling fabrics than would be the case if the article were placed in a flat relationship to the exhaust outlet.

ARTICLE MANUFACTURE

The articles herein are fashioned from a dryer dispensing means and from softening compositions comprising from about 40% to 95%, preferably from about 50% to 85% and most preferably 50% to 70%, of the cationic softener, and from about 5% to about 60%, preferably 15% to 50% and most preferably from about 30% to 50%, of the lanolin alcohol component. The weight ratio of cationic softener to lanolin alcohol component is such compositions is greater than 0.67:1 and is preferably greater than 1:1, and most preferably, in the range of from about 2:1 to 5:1. Such softening compositions, as noted, can be employed in combination with a wide variety of dispensing means in order to realize the instant fabric softening articles.

Highly preferred articles herein are those wherein the softening composition is impregnated into an absorbent substrate. The impregnation can be accomplished in any convenient manner, and many methods are known in the art. For example, the composition, in liquid form, can be sprayed onto a substrate or can be added to a slurry from which the substrate is manufactured.

Impregnating, rather than coating the substrate with the softening composition is highly preferred for optimal softening with minimal fabric staining. The term "coating" connotes the adjoining of one substance to the external surface of another; "impregnating" is intended to mean the permeation of the entire substrate structure, internally as well as externally. One factor affecting a given substrate's absorbent capacity is its free space. Accordingly, when the softening composition is applied to an absorbent substrate it penetrates into the free space; hence, the substrate is deemed impregnated. The free space in a substrate of low absorbency, such as a one-ply kraft or bond paper, is very limited; such a substrate is, therefore, termed "dense". Thus, while a small portion of the softening composition penetrates into the limited free space available in a dense substrate, a rather substantial balance of the composition does not penetrate and remains on the surface of the substrate so that it is deemed a coating. The difference between coating and impregnation is believed to explain why the impregnated sheet substrates of the invention herein eliminate or substantially reduce the staining of fabrics observed when a coated dense substrate is utilized.

In one preferred method of making the preferred softening composition-impregnated absorbent sheet substrate, the mixed softening composition (alone or with the optional additives) is applied to absorbent paper or non-woven cloth by a method generally known as padding. Another preferred method involves forcing the softener into the sheet substrate while the sheet is under tension. This method is described in application Ser. No. 530,312, Kissner, filed Dec. 5, 1974, incorporated by reference herein. The softening composition is preferably applied in liquid form to the substrate. Thus, the softening compositions which are normally solid or semi-solid at room temperature should first be melted and/or solvent treated with one of the liquid carriers mentioned hereinbefore. Methods of melting the softening compositions and/or for treating them with a solvent are known and can easily be done to provide a satisfactory impregnated substrate.

In another preferred method, the softening composition in liquified form is placed in a pan or trough which can be heated to maintain the composition in liquid form. The liquid composition contains any of the desired optional additives. A roll of absorbent paper (or cloth) is then set up on an apparatus so that it can unroll freely. As the paper or cloth unrolls, it travels downwardly and, submersed, passes through the pan or trough containing the liquid composition at a slow enough speed to allow sufficient impregnation. The absorbent paper or cloth then travels upwardly and through a pair of rollers which remove excess bath liquid and provide the absorbent paper with about 1 to about 12 grams of the softening agent per 100 in.$^2$ to 150 in.$^2$ of substrate sheet. The impregnated paper or cloth is then cooled to room temperature, after which it can be folded, cut or perforated at uniform lengths, and subsequently packaged and/or used.

The rollers used resemble "squeeze rolls" used by those in the paper and paper-making art; they can be made of hard rubber or steel. Preferably, the rollers are adjustable, so that the opening between their respective surfaces can be regulated to control the amount of the softener composition liquid on the paper or cloth.

In another method of impregnation, the softener composition, in liquid form, is sprayed onto absorbent paper or cloth as it unrolls and the excess material is then squeezed off by the use of squeeze rollers or by a doctor-knife. Other variations include the use of metal "nip" rollers on the leading or entering surfaces of the sheets onto which the softening composition is sprayed; this variation allows the absorbent paper or cloth to be treated, usually on one side only, just prior to passing between the rollers whereby excess material is squeezed off. This variation can optionally involve the use of metal rollers which can be heated to maintain the softening composition herein in the liquid phase. A further method involves separately treating a desired number of the individual plies of a multi-ply paper and subsequently adhesively joining the plies with a known adhesive-joinder compound; this provides an article which can be untreated on one of its sides, yet contains several other plies, each of which is treated on both sides.

In applying the softening composition to the absorbent substrate, the amount impregnated into and/or coated onto the absorbent substrate is conveniently in the weight ratio range of from about 10:1 to 0.5:1 based on the ratio of total softening composition to dry, untreated substrate (fiber plus binder). Preferably, the amount of the softening composition ranges from about 5:1 to about 1:1, most preferably from about 3:1 to 1:1, by weight of the dry, untreated substrate.

Following application of the liquified softening composition, the articles are held at room temperature until the softening composition substantially solidifies. The resulting dry articles, prepared at the composition:substrate ratios set forth above, remain flexible; the sheet articles are suitable for packaging in rolls or they can be cut and packaged as stacks of individual sheets of a size suitable for one usage each. The sheet articles can optionally be slitted or punched to provide a non-blocking aspect at any convenient time during the manufacturing process.

The most highly preferred articles herein are those where a softening composition of the type disclosed above is releasably affixed to a woven or non-woven cloth or sheet substrate of the type disclosed hereinabove having an absorbent capacity of from about 4 to about 12. A highly preferred woven or non-woven sheet substrate for such an article has an absorbent capacity from about 5 to 7. The most highly preferred substrate for the articles comprises a water-laid or air-laid non-woven cloth consisting essentially of cellulosic (including rayon) fibers, said fibers having a length of about 3/17 inch to about 2 inches and a denier from about 1.5 to about 5, said fibers being at least partially oriented haphazardly, and adhesively bonded together with a binder-resin. Such water-laid or air-laid non-woven cloths can easily be prepared having the preferred absorbent capacities set forth above.

It is most convenient to provide an article in the form of a non-blocking sheet substrate having the physical parameters noted hereinabove, said substrate having an area of from about 50 in.$^2$ to about 200 in.$^2$, containing from about 1.5 grams to about 7.5 grams of a softening composition, especially one comprising from about 50% to about 85% by weight of a quaternary ammonium softener of the type disclosed hereinabove (especially ditallowdimethylammonium methylsulfate) and from about 15% to about 50% by weight of the above-described lanolin alcohols and derivatives thereof. Such articles can be provided with, as an additional component, from about 0.01% to about 10% by weight of the fabric softening composition of optional fabric treating additives of the type disclosed hereinabove. The articles are provided with openings such as the holes or slits described hereinabove, said openings comprising from about 0.5% to about 75%, preferably 5% to about 40%, of the area of the article, said openings being so disposed as to provide a non-blocking effect.

It should be noted that the preferred absorbent substrate articles described above are surprisingly easy to manufacture on a commercial scale. Production of these substrates with the particular two component softening compositions of the instant invention generally results in a significantly lower level of softener composition dusting and buildup on machinery in comparison to dusting and buildup resulting from the manufacture of similar prior art products utilizing quaternary materials alone.

USAGE

In the method aspect of this invention the mixed fabric softening compositions are used in an effective amount to soften and condition fabrics in an automatic dryer. The effective, i.e., softening and static-controlling, amount of the compositions used in the manner of this invention will depend somewhat on the type of fabric being treated and the dampness of the surrounding atmosphere. For example, it is well-known that under conditions of low humidity, static control in fabrics is somewhat more difficult to achieve than under conditions of high humidity.

For most purposes, the compositions herein are applied to fabrics at a rate of about 0.01 gram to about 12.0 grams, preferably 1 g. to about 3 g., per 5 lbs. of fabrics on a dry fabric weight basis. Higher usage rates can be employed, if desired, but can result in an undesirable greasy feel on the fabrics.

The method herein is carried out in the following manner. Damp fabrics, usually containing from about 1 to about 1.5 times their weight of water, are placed in the drum of an automatic clothes dryer. In practice, such damp fabrics are commonly obtained by laundering, rinsing and spin-drying the fabrics in a standard washing machine. The softening compositions herein are simply spread in a fairly uniform manner over all fabric surfaces in any suitable manner, for example, by sprinkling them onto the fabrics from a shaker device or contacting the fabrics with a flexible substrate which dispenses the softener composition onto the fabrics. Alternatively, the compositions can be sprayed (e.g., from a pump spray or propellant-charged aerosol container) or otherwise coated on the dryer drum itself. The dryer is operated in standard fashion to dry the fabrics, at a temperature at least equal to or higher than the melting point of the softener composition, i.e., from about 38° to 100° C., preferably about 50° to about 80° C., for a period of from about 10 minutes to about 60 minutes, depending on the fabric load and type. On removal from the dryer, the dried fabrics are softened and coated with the composition which quickly and effectively dissipates static charge.

In the preferred mode, the present process is carried out by fashioning an article comprising the substrate dispensing means of the type hereinabove described in releasable combination with the softening composition. This article is simply added to a clothes dryer together with the damp fabrics to be treated. The heat and tumbling action of the revolving dryer drum evenly distributes the composition over all fabric surfaces, and dries the fabrics.

Significant fabric softening effects can also be obtained when the fabric softening compositions herein are dispensed into the rinse cycle of the washing process instead of in the dryer. A particularly preferred dispensing means for use in the rinse cycle is a flexible substrate of the types described herein.

The following are examples of the articles and methods of this invention but are not to be considered limiting thereof.

EXAMPLE I

A dryer-added fabric softening article is prepared by spreading 2.5 grams of a softening composition comprising 2.0 grams of mixed ditallowdimethylammonium methylsulfate and 0.5 gram of acetylated lanolin alcohols (ACETULAN ® from Amerchol) uniformly over the surface of a 10 inch by 11 inch piece of air-laid non-woven cloth comprising 70% regenerated cellulose (American Viscose Corporation) and 30% hydrophobic binder-resin (Rhoplex HA-8 on one side of the cloth, and Rhoplex HA-16 on the other side; Rohm & Haas Co.). The cloth has a thickness of 4 to 5 mils, a basis weight of about 24 grams per square yard and an absorbent capacity of 6. A one foot length of the cloth, $8\frac{1}{3}$ inches wide, weighs about 1.78 grams. The fibers in the cloth are ca. $\frac{1}{4}$ inch in length, 3.0 denier, and are oriented substantially haphazardly. The fibers in the cloth are lubricated with sodium oleate. The substrate cloth is 10 inch by 11 inch. The coated cloth is transferred to a heated plate, whereupon the composition melts and impregnates the interfiber free space in the cloth substrate. The article is removed from the hot plate and allowed to cool to room temperature, whereby the softening composition solidifies. The cloth retains its flexibility.

Following solidification of the softening composition, the cloth is slitted with a knife. (Conveniently, the cloth is provided with 5 to 9 rectilinear slits extending along one dimension of the substrate, said slits being in a substantially parallel relationship and extending to within about one inch from at least one edge of said dimension of the substrate.) The width of an individual slit is ca. 0.2 inches.

An article prepared in the foregoing manner is placed in an automatic clothes dryer together with 5 lbs. of freshly washed, damp (ca. 5.5 lbs. water) mixed cotton, polyester, and polyester/cotton blend clothes. The automatic dryer is operated at an average temperature of 60° C for a period of 45 minutes. During the course of the drying operation the clothes and softener article are constantly tumbled together by the rotation of the dryer drum. After the drying cycle, the clothes are removed from the dryer into a room having a relative humidity of 50%. The clothes are found to exhibit excellent softness and anti-static properties.

When a similar article is prepared from the quaternary softener, but without added lanolin alcohol ester, and the article is used in the manner above, a substantially lower proportion of the softener is found to have been transferred from the article to the fabrics. Moreover, upon repeated use in a dryer, the articles containing lanolin alcohol ester, as above, are found to produce significantly less softening of paint and corrosion of metal on interior areas of the dryer than similar articles containing only ditallowdimethylammonium methylsulfate. Substantially similar results to the above are obtained when acetulated lanolin in the foregoing composition is replaced by an equal amount of linoleated lanolin alcohols (POLYAN ® from Amerchol).

EXAMPLE II

A dryer-added fabric softening article is prepared in the following manner. A softening composition comprising 70% by weight of ditallowalkyldimethylammonium chloride and 30% by weight of a mixture of lanolin alcohols (AMERCHOL CAB ®) is placed in a trough and heated until melted.

A 10 inch wide roll of paper substrate is utilized, said substrate being a compressible, laminated and calendered absorbent paper structure comprising two extensible paper sheets, each sheet (or ply) having a basis weight of about 16 lbs. per 3000 square feet and a MD value of about 660, a CD value of about 380 and 20% dry-crepe. Each sheet of the paper substrate is embossed with identical raised patterns consisting of about 70 inwardly directed discrete protuberences per square inch, raised about 0.02 inches above the surface of the paper sheets. The protuberences constitute about 45% of the surface of each sheet and are mated and adhesively joined with polyvinyl alcohol resin. The paper structure exhibits a compressive modulus of about 340 together with HOM MD/CD values of about 36/31 and has an absorbent capacity of about 7. (This paper is a particularly preferred paper substrate herein and weighs about 3.7 grams per 10 inch × 12 inch sheet.)

The paper sheet substrate is mounted on a roll and is unrolled in the trough. The paper travels at a rate of 5–6 feet per minute and is then directed upwardly and through the pair of hard, rubber rollers mounted so that their surfaces just touch. The turning rollers squeeze off excess softening composition and impregnate the paper with the composition at a composition:paper impregnation ratio of about 2.7:1 by weight of the dry, untreated paper. After passing through the rollers, the liquified composition (now impregnated into the paper) is cooled and hardened. The resulting paper article is substantially solid, yet flexible, is stable to decomposition, not "runny" or dripping, and which, although waxy to the touch, does not stick together when folded.

A 10 in. × 12 in. paper-impregnated article prepared in the foregoing manner is punched with 9 evenly-spaced 0.5 in. diameter holes. The resulting article contains about 8 grams of the softening composition. The article is placed in an automatic clothes dryer together with 5 lbs. of mixed clothes which are dampened with an equal amount of water. The dryer is operated at an average temperature of 56° C. for a period of 40 minutes, with tumbling. At the end of the drying cycle, the clothing is removed from the dryer and is found to be provided with an excellent soft and anti-static finish. The dryer operates without any vent blockage. Moreover, repeated usage of this product in an automatic clothes dryer produces a substantially lower level of paint softening and metal corrosion in the dryer than does a similar product wherein the fabric conditioning ingredient is all ditallowdimethylammonium chloride. In the foregoing article the lanolin alcohols are replaced by an equal weight amount of the reaction product of two moles of propylene oxide with one mole of lanolin alcohols (SOLULAN PB-2 ® from Amerchol) or the reaction product of 20 moles of propylene oxide and one mole of lanolin alcohols (SOLULAN PB-20 ® from Amerchol), and similar performance results to those obtained with the lanolin alcohols are obtained.

EXAMPLE III

An article which can be used to provide thru-the-dryer fabric softening is prepared in aerosol form. 25 Grams of a mixture comprising 20 grams of di-(hydrogenated tallowalkyl)dimethylammonium methylsulfate and 5 grams of AMERCHOL 400 ® lanolin alcohols are admixed with 50 mls. of isopropyl alcohol until a homogeneous mixture is secured. The mixture is placed in a suitable aerosol container to which is added (under pressure) 15 mls. of a 1:1 (wt.) mixture of liquified dichlorodifluoroethane and dichlorodifluoromethane propellant gas. Following the pressure fill, the aerosol can is provided with a standard actuator valve and dip tube extending to the bottom of the can.

A standard laundry dryer drum, at ambient temperature, is sprayed uniformly with 10 grams of the foregoing aerosol composition. 5 Pounds of damp clothing containing about 5 lbs. of water are added to the dryer drum, and the dryer is operated in standard fashion at a temperature averaging around 57° C. for a period of 35 minutes. After the drying cycle is over, the clothes are allowed to come to ambient temperature and are removed from the dryer. The clothes are found to be provided with a soft, anti-static finish. Moreover, upon repeated usage in a dryer, this composition gives improved freedom from paint softening and metal corrosion, in the dryer, compared to a similar product wherein the fabric conditioning agents consist only of di-(hydrogenated tallowalkyl)dimethylammonium-methylsulfate.

What is claimed is:

1. An article of manufacture adapted for providing fabric softening within an automatic laundry dryer, said article comprising:

(a) a fabric softening amount of a softening composition, said composition having a melting point above about 38° C. and being flowable at fabric dryer operating temperature, said composition comprising:
  (i) from about 50% to about 95% by weight of the composition of a quaternary ammonium fabric softener material; and
  (ii) from about 5% up to about 50% by weight of the composition of lanolin alcohol component selected from the group consisting of lanolin alcohols, the aliphatic carboxylic acid esters of lanolin alcohols wherein the acid moieties of said esters contain from about 2 to about 22 carbon atoms and the propylene oxide adducts of lanolin alcohols wherein said adducts are the reaction product of from about 2 to about 20 moles of propylene oxide per mole of lanolin alcohols; and (b) a dispensing means which provides for release of said softening composition within an automatic laundry dryer at dryer operating temperatures.

2. An article according to claim 1 wherein the quaternary ammonium softener is in the methylsulfate form.

3. An article according to claim 2 wherein the quaternary ammonium softener is selected from the group consisting of ditallowalkyldimethylammonium methylsulfate, distearyldimethylammonium methylsulfate, dipalmityldimethylammonium methylsulfate and dibehenyldimethylammonium methylsulfate.

4. An article according to claim 3 wherein the amount of Component (i) in the softening composition is from about 50% to about 85% by weight of the softening composition.

5. An article according to claim 1 wherein the dispensing means comprises a flexible substrate in sheet configuration having the softening composition releasably affixed thereto.

6. An article according to claim 5 wherein the dispensing means comprises a flexible substrate in sheet configuration having an absorbent capacity of from about 2 to about 25 wherein the softening composition is impregnated into the substrate to provide a weight ratio of softening composition to dry substrate ranging from about 10:1 to about 0.5:1 and wherein said softening composition comprises from about 50% to about 85% of Component (i) and from about 15% to about 50% of Component (ii).

7. An article according to claim 6 wherein the substrate is a woven or non-woven cellulosic cloth or paper and has an absorbent capacity of from about 4 to about 12.

8. An article according to claim 7 wherein the substrate is a foamed plastic sheet having an absorbent capacity of from about 15 to about 22.

9. An article according to claim 1 wherein the dispensing means is an aerosol device.

10. A method for imparting a softening and anti-static effect to fabrics in an automatic laundry dryer comprising commingling pieces of damp fabrics by tumbling said fabrics under heat in an automatic clothes dryer with an effective amount of a fabric softening composition, said composition having a melting point above about 38° C and being flowable at fabric dryer operating temperatures, said composition comprising:

(i) from about 50% to about 95% by weight of the composition of a cationic quaternary ammonium softener material; and
(ii) from about 5% up to about 50% by weight of the composition of lanolin alcohol component selected from the group consisting of lanolin alcohols, the aliphatic carboxylic acid esters of lanolin alcohols wherein the acid moieties of said esters contain from about 2 to about 22 carbon atoms and the propylene oxide adducts of lanolin alcohols wherein said adducts are the reaction product of from about 1 to about 20 moles of propylene oxide per mole of lanolin alcohols wherein said tumbling takes place at a temperature equal to or above that at which the fabric softening composition will flow.

11. The method of claim 10 wherein the quaternary ammonium softener is in the methylsulfate form.

12. The method according to claim 11 wherein the quaternary ammonium softener is selected from the group consisting of ditallowalkyldimethylammonium methylsulfate, distearyldimethylammonium methylsulfate, dipalmityldimethylammonium methylsulfate and dibehenyldimethylammonium methylsulfate.

13. The method of claim 12 wherein the amount of Component (i) in the softening composition is from about 50% to about 80% by weight of the softening composition.

14. The method according to claim 10 wherein the composition is dispensed within the dryer from a flexible substrate sheet having the softener composition releasably affixed thereto.

15. The method of claim 14 wherein the dispensing means comprises a flexible substrate in sheet configuration having an absorbent capacity of from about 2 to about 25 wherein the softening composition is impregnated into the substrate to provide a weight ratio of softening composition to dry substrate ranging from about 10:1 to about 0.5:1 and wherein said softening composition comprises from about 50% to about 85% of Component (i) and from about 15% to about 50% of Component (ii).

16. The method of claim 15 wherein the substrate is a woven or non-woven cellulosic cloth or paper and has an absorbent capacity of from about 4 to about 12.

17. The method of claim 16 wherein the substrate is a foamed plastic sheet having an absorbent capacity of from about 15 to about 22.

18. The method according to claim 10 wherein the softener composition is dispensed into the dryer from an aerosol dispensing device in a manner so as to coat the dryer drum before tumbling the fabrics in the dryer.

* * * * *